US006045960A

United States Patent [19]

Neilson et al.

[11] Patent Number: 6,045,960

[45] Date of Patent: Apr. 4, 2000

[54] POWDER COMPOSITION SUITABLE FOR A TONER

[75] Inventors: Ian Stuart Neilson, Clevedon; Michael David Sturt, Frome, both of United Kingdom

[73] Assignee: Coates Brothers PLC, United Kingdom

[21] Appl. No.: 08/973,048

[22] PCT Filed: Jun. 3, 1996

[86] PCT No.: PCT/GB96/01305

§ 371 Date: Mar. 27, 1998

§ 102(e) Date: Mar. 27, 1998

[87] PCT Pub. No.: WO96/38768

PCT Pub. Date: Dec. 5, 1996

[30] Foreign Application Priority Data

Jun. 2, 1995 [GB] United Kingdom ..... 9511150
May 7, 1996 [GB] United Kingdom ..... 9609515

[51] Int. Cl.[7] ..... G03G 9/097

[52] U.S. Cl. ..... 430/110

[58] Field of Search ..... 430/110

[56] References Cited

U.S. PATENT DOCUMENTS 5,272,040 12/1993 Nakasawa et al. ..... 430/110

*Primary Examiner*—Roland Martin
*Attorney, Agent, or Firm*—Ostrolenk, Faber, Gerb & Soffen, LLP

[57] ABSTRACT

A powder toner composition includes a particulate synthetic thermoplastic material, refractory metal oxides, and a powder lubricant. The particulate synthetic thermoplastic material is surface coated with a blend of the refractory metal oxides and the powder lubricant. At least one of the refractory metal oxides is surface-treated. The powder compositions exhibit fluid properties when subjected to mechanical agitation or aeration, and settle as compacted solids when agitation/aeration ceases. The compositions exhibit behavior substantially free of slugging, channeling and jetting when aerated.

20 Claims, No Drawings

POWDER COMPOSITION SUITABLE FOR A TONER

This invention is concerned with improvements in and relating to powders, and in particular, powder toners for use as developers in electrostatographic reproductions apparatus. The invention is especially concerned with single component toners which may, for example, find use in apparatus wherein toner is maintained in a charged fluidised bed whence the charged toner is supplied to applicator means for applying it to the desired substrate. Such apparatus is described, for example, in EP-A-0 494 544.

Some conventional toners exhibit fluid properties (and in particular, liquid-like properties) when subjected to mechanical agitation and when return to rest, become compacted. However, the present invention is in part, derived from an unexpected observation that some toners which are new, exhibit much greater fluidity when subjected to mechanical agitation or aeration. This is a primary property of such toners. Normally, when the agitation is stopped, they eventually settle with a somewhat greater degree of compaction in comparison with the aforementioned known toners. This is in contrast to the conventional toners which do not achieve such a degree of compaction at rest. It has been found that this fluidization (and compaction) behaviour is an indicator marked suitability for use in apparatus of the kind described in EP-A-0 494 544. Many of these toners are also substantially free of properties which are disadvantageous when they are used in that apparatus.

However, in the broadest sense, this novel behaviour, and therefore the present invention, is not limited to toner compositions but in principle, to other compositions intended for other applications. Thus, in a first aspect the present invention provides a powder composition which exhibits fluid properties when subjected to mechanical agitation or aeration and which settles as a compacted solid when the aeration or agitation ceases, said composition exhibiting behaviour substantially free of slugging, channelling and jetting when aerated.

Preferred "fluidizable" powder compositions according to any aspect of the present invention include those which exhibit liquid-like behaviour when aerated in the aforementioned kind of fluidised bed described in EP-A-0 494 544, even if they do not exhibit a marked liquid-like behaviour upon mere mechanical agitation. These especially preferred compositions are not prone to slugging, channelling or jetting, and preferably also not to spouting when used in this apparatus. These terms are standard terminology for the behaviour of powders in fluidised bed systems and as used herein, have the meanings described in Ch. 6, D. Geldhart "Gas Fluidization" in M. J. Rhodes (Ed.) Principles of Powder Technology, Wiley 1990 (incorporated herein by reference), for example as explained in and with reference to FIG. 6.3 of the latter reference.

Compositions according to any aspect of the invention may be identified not only by their fluid-like behaviour when agitated, but preferably also by their degree of compaction in terms of the "compaction ratio" of such compositions. As used herein, the term compaction ratio means the ratio of the maximum height of the surface of the composition when vigorously agitated in a cylindrical container to the minimum height attained by the surface when at rest. Preferably, this compaction ratio is at least 3:2, more preferably at least 7:4.

In a second aspect, the present invention provides a fluidizable powder composition comprising particles of synthetic thermoplastic material blended with a (preferably surface-treated) particulate refractory metal oxide material.

Optionally, compositions according to either of the first or second aspects of the present invention may also possess the features of the other.

In the context of the present invention, the term "fluidizable" as applied to a powder composition includes those powder compositions which demonstrate the above-mentioned fluid behaviour upon aeration or agitation. Thus, the fluidity of the powder compositions in the aerated/agitated state is important. Preferred compositions according to any aspect of the present invention, when aerated or agitated, have a viscosity of from 1 to 8 centpoise (mPa $s^{-1}$). Above the upper limit of this range, there is a gradual onset of lack of fluidity. Below the lower limit, there is gradual onset of dusty behaviour, giving rise to a tendency for the powder to become dispersed in the surrounding atmosphere, potentially giving rise to risk of health and safety problems and of fouling other parts of the equipment. Most preferred are those compositions which have a viscosity of less than 5 centipoise, especially from 1.5 to 3 centipoise. This viscosity is most preferably measured using the following equipment and test protocol.

A cylindrical fluidizing cell having an internal diameter of 50.5 mm and a height of 122.1 mm is supported above a sintered metal plate, to which is supplied air at 0.5 cfh. The bottom of the cell is supported at 7.9 mm above the sintered bed when contained in the bed. The "00" spindle of a Brookfield viscometer model LVTDV-II is suspended inside the fluidizing cell. The viscometer motor is first set at 12 rpm and zeroed without the spindle attached. The speed is then increased to 60 rpm and the measurement is taken with the spindle attached and supported inside the fluidizing cell at a height of 20 mm above the sintered bed with the fluidizing cell containing 60 g of the test powder composition. The equipment is allowed to run for approximately 5 minutes to settle and the viscosity is then read from the instrument.

As indicated above a preferred form of powder compositions according to the present invention comprises those formulated as toners for use in electrostatographic reproduction apparatus, e.g. a printer or photocopier.

Especially preferred toner compositions of the invention are intended to be suitable for use in apparatus, such as that described in EP-A-0 494 544, in which the toner is maintained in a fluidized bed. In order to be suitable for this application, the composition of the invention must be fluidizable without slugging, channelling or jetting.

In some applications, the ability of the composition to assume a triboelectric charge can also be important. Thus, according to a third aspect of the present invention there is provided a single-component toner comprising particles of a synthetic thermoplastic material, preferably having a charge control agent dispersed therein, the said thermoplastic particles being blended with a particulate refractory metal oxide; the toner as a whole being such that it develops a triboelectric charge of not more than ±5 microcoulombs/gm. However, the latter limit of triboelectric charge preferably applies to compositions according to any aspect of the present invention.

As noted above, a toner composition according to the third aspect of the invention is required to develop a limited triboelectric charge when measured by a conventional test method. An appropriate test method is as follows:

1. Make a 4% blend of toner with a carrier (such as a silicone coated steel shot that has an average size of 150$\mu$ but no significant fraction below 38$\mu$).
2. Tumble blend this mixture for 30 minutes.
3. Take 0.5 g of the blend and place it in a Faraday Cage that has a 38$\mu$ mesh at each end of the metal container. Weigh the assembly.

4. Blow air into the cage and extract the toner with vacuum that comes out of the other end for 30 seconds while measuring the charge accumulated on the Faraday Cage using an electrometer.
5. Weigh the assembly to calculate the amount of toner removed from the mixture.
6. Calculate the charge per unit mass of toner=specific charge of the toner.

Generally speaking, any refractory metal oxide composition according to the present invention should have a weight average particle diameter below 1$\mu$. Such particles may have a surface area density of from 100 to 400 $m^2/g$, preferably from 160 to 330 $m^2/g$.

The principal component of compositions of the present invention comprises the thermoplastic particles and these suitably form from 85 to 98% by weight, preferably 91 to 96% by weight of the total composition. For magnetic toners though, the amount of particulate thermoplastic material may be anything down to 60% by weight of the total composition. For clear (i.e. non-coloured) compositions, the amount of particulate thermoplastic material may exceed 98% by weight. A wide variety of thermoplastic materials may be used. These suitably have melting or softening points of from 80 to 150° C., preferably 100 to 140° C. (As measured by the Kofler Hot Bench method).

Particularly suitable thermoplastic materials for use in accordance with the compositions of the invention are polyester resins, particularly those polyester resins having at least one hydroxyl functional group. Other suitable resins are styrene-type resins such as polystyrene, chloropolystyrene, poly-alpha-methylstyrene, styrene/chlorostyrene, copolymer, styrene/propylene copolymer, styrene/butadiene copolymer, styrene/vinyl chloride copolymer, styrene/vinyl acetate copolymer, styrene/maleic acid copolymer, styrene/acrylic ester copolymer (styrene/methyl acrylate copolymer, styrene/butyl acrylate copolymer, styrene/octyl acrylate copolymer, styrene/phenyl acrylate copolymer, styrene/2-ethyl hexyl acrylate copolymer), styrene-methacrylic ester copolymer (styrene-methyl methacrylate, styrene/ethyl methacrylate copolymer, styrene/butyl methacrylate copolymer, styrene/phenyl methacrylate copolymer), styrene-alpha-methyl chloracrylate copolymer, styrene/acrylonitrile/acrylic acid ester terpolymer, vinyl chloride resin; rodine denatured maleic resin; phenolic resin; epoxy resins; polyester resin; low molecular weight polyethylene; low molecular weight polypropylene; lonomer resin; polyurethane resin; ketone resin; and polyvinyl butyral. Any of the aforementioned resins may be used alone or in combination.

For some applications, the thermoplastic materials may also contain one or more waxes. Such waxes suitably have a melting point of from 80 to 150° C., as measured by the drop point method. Examples of suitable waxes are natural waxes and synthetic waxes such as low molecular weight polyethylenes, polypropylenes, oxidised polyolefins, ester waxes, hydrogenated ester waxes, amide waxes, ketone waxes and alcohol waxes. Examples of such waxes are Polywax 1000 from Petrolite Corporation and Wax 'C' from Hoechst.

The thermoplastic particles suitably have a mean size ($d_{50}$) of 7 to 25 microns, especially 8–12 microns. This particle size is most conveniently achieved by grinding an initial larger size composition comprising thermoplastic material having charge control agent and colourant dispersed therein down to the desired size, prior to adding the further additive(s) noted above.

The base thermoplastic material of the thermoplastic particles preferably has a charge control agent dispersed therein, although such charge control agents may be dosed separately into the final composition. The amount of charge control agent is preferably from 0.5 to 5% by weight of the total composition. Carbon black pigment usually behaves as a charge control agent and in the presence of same, other charge control agent may be used below the 0.5% level or omitted altogether. Suitable charge control agents for use for this purpose include metal salts and those with pendant hydroxy groups, or quaternary ammonium charge control agents. However, as used in any claim appended hereto, the term "charge control agent" includes carbon black.

Preferred positive charge control agents include nigrosine and its modification products modified by a fatty acid metal salt; quaternary ammonium salts, such as tributylbenzylammonium-1-hydroxy-4-naphthosulfonic acid salt, and tetrabutylammonium tetrafluoroborate; diorganotin oxides, such as dibutyltin oxide, dioctyltin oxide, and dicyclohexyltin oxide, and diorganotin borates, such as dibutyltin borate, dioctyltin borate, and dicyclohexyltin borate.

Preferred negative charge control agents include an organic metal complex or a chelate compound, such as aluminium acetyl-acetonate, iron (II) acetylacetonate, and a 3,5-ditertiary butylsalicylic acid chromium; acetylacetone complexes (inclusive of monoalkyl- or dialkyl-substituted derivatives thereof), or salicylic acid-type metal salts or complexes (inclusive of monoalkyl- or dialkyl-substituted derivatives thereof).

The thermoplastic particles, whilst having the limited triboelectric charging properties noted above, should be capable of being electrically charged, e.g. by corona discharge. To this end, the particles should preferably have a dielectric constant of not more than 10, preferably from 2 to 8, e.g. from 2 to 5. Similarly, the thermoplastic particles should have a dissipation factor, or tan delta, of not more than 0.3.

If the composition of the invention is formulated as a toner, then in order to render the thermoplastic particles visible, when applied to the intended substrate, they should also contain a colourant such as a pigment or dyestuff. Additionally or alternatively, they may contain an additive to endow another special visible property, e.g. UV fluorescence. Although the toner would normally be a single component non-magnetic material, there are special cases such as MICR (i.e. magnetic coding—such as on cheques) where one would want to incorporate a magnetic pigment.

One class of colourants which may be incorporated in compositions according to the invention include pigments, for example selected from cyan, magenta, or yellow pigments and mixtures thereof.

Suitable pigments and dyestuffs include Violet Toner VT-8015 (ex Paul Uhlich), Normandy Magenta RD-2400 (ex Paul Uhlich), Paliogen Violet 5100 (ex BASF), Paliogen Violet 5890 (ex BASF), Heliogen Green L8730 (ex BASF), and Bon Red 6 (ex Dominion Color Company).

Examples of magenta materials that may be selected as pigments, includes, for example, 2,9-dimethyl substituted quinacridone. Illustrative examples of cyan are copper tetra 4 (oxtadecyl sulfonamido) phthalocyanine and Cl Pigment Blue. An illustrative example of a yellow pigment that may be used is diarylide yellow 3,3-dichlorobenzidene acetoacetanilides.

Suitable refractory metal oxides for use in compositions according to the present invention include silica, alumina and titanium dioxide, as well as aluminosilicates and mixtures thereof. As used herein, the term primary refractory metal oxides refers to those oxides, e.g. silica, which have a beneficial effect on the flows properties of the composition.

Secondary refractory metal oxides refers to those oxides which further enhance the flow and modify the charge in the presence of relatively high amounts of the primary oxides, e.g. alumina or titanium dioxide, especially surface treated forms thereof (see below). Generally speaking, the compositions will contain a higher amount of the primary oxides than the secondary, although equal quantities or the reverse are also possible. It is especially preferred to include both primary and secondary refractory metal oxides.

The term refractory metal oxide has the meaning commonly used, for example in Kirk-Othmer, Concise Encyclopaedia of Chemical Technology, Wiley Interscience, New York, 1985. Preferably , the refractory metal oxides are surface treated. In the case of compositions according to the second aspect of the present invention, it is essential that the refractory metal oxides are surface treated. Examples of coated silicas and ultrafine inorganic powders such as surface treated titanium dioxide are available from manufacturers such as Degussa A. G., Cabot Corporation and Kemira Vuorikemia. It is also preferred for the refractory metal oxides to be in the a morphous state.

The particles of the refractory metal oxide material will usually have a mean diameter ($d_{50}$) of less than one micron, for example from 0.01 to 1 microns, more preferably from 0.1 to 0.5 microns.

Suitable species for surface treatment of the refractory metal oxide particles are silane coupling agents, preferably terminated with relatively inert non-polar species, e.g. for neutralisation of surface and/or enhancing hydrophobicity.

Examples of such silane coupling agents are phenyltrimethoxy silane, isobutyltrimethoxy silane, hexyltrimethoxy silane, octyl-trimethoxy silane, decyltrimethoxy silane, methylhydrogen polysiloxane, aminopropyltriniethoxysilane, aminopropyltriethoxysilane, demethylaminopropyltrimethoxysilane, dipropylaminopropyltrimethoxysilane, dibutylaminopropyltrimethoxysilane, monobutylaminopropyltrimethoxysilane, dioctylaminopropyltrimtethoxysilane, dibutylaminopropylmonoethoxysilane, dimethylaminophenyltriethoxysilane, trimethoxysilyl-γ-propylphenylamine, and trimethoxysilyl-γ-propylbenzylamine. Further examples of the nitrogen-containing heterocyclic compounds represented by the above structural formulae include trimethoxysilyl-γ-propylpiperidine, trimethoxysilyl-γ-propylmorpholine, and trimethoxysilyl-γ-propylimidazole.

The silica fine powder used in the present invention may also be treated as desired with another silane coupling agent or with an organic silicon compound for the purpose of enhancing hydrophobicity. The silica powder may be treated with such agents in a known manner so that they react with or are physically adsorbed by the silica powder.

Examples of such treating agents include hexamethyldisilazane, trimethylsilane, trimethylchlorosilane, trimethylethoxysilane, dimethyldichlorosilane, ethyltrichlorosilane, allyldimethychlorosilane, allylphenyldichlorosilane, benzyldimethychlorosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and each containing one hydroxyl group bonded to Si at the terminal units, used alone or as a mixture of two or more such agents.

Another optional additive is a powder lubricant such as polyvinylidene fluoride (PVDF), polytetrafluoroethylene (PTFE), or a stearate e.g. zinc stearate. In the preparation of the compositions of the invention, the thermoplastic particles are dry blended with the additive(s) and the powder lubricant is suitably blended in the form of particles having a mean size of 0.1 to 1.0μ.

Another optional additive is in the form of substantially spherical particles of from 0.1 to 2μ in size of acrylic polymer, e.g. as described and claimed in EP-A-0 410 483. Such particles may have a resistivity of from $10_6$–$10^{12}$ Ωcm.

The total quantity of additives in the compositions of the invention should be from 0.2 to 5, e.g. 0.5 to 2.5, more preferably 1 to 2 and especially from 1.1 to 1.8% by weight. Within these limits the three possible additives themselves are suitably, or preferably, present in the amounts (based on the total composition) indicated in the Table below.

| Amounts % by weight | | | |
|---|---|---|---|
| Additive | Suitable | Preferred | Most Preferred |
| Primary R.M. Oxide particles | 0.05 to 5.0 | 0.1 to 2.0 | 0.4 to 1.5 |
| Secondary R.M. Oxide particles | 0.05 to 5.0 | 0.1 to 2.0 | 0.4 to 1.5 |
| Powder lubricant | 0 to 1.0 | 0.05 to 0.5 | 0.1 to 0.3 |

(R.M. = Refractory metal)

Dry blending of the thermoplastic particles with the three additives is conveniently effected in an apparatus such as Henschel mixer or a high speed cavitation mixer. It is believed that by such dry blending the surface of the thermoplastic particles becomes coated with a mixture of the three additives.

In order that the invention may be better understood the following examples are given by way of illustration only.

Toner compositions were prepared using a mixture of materials as shown in the following examples.

These were melt blended and ground and classified to a particle size of 12 microns with a distribution between 5–32 microns.

Each of these toners was then surface treated by blending with additives in each of various blends listed below.

| Base Toner Composition | Material | % |
|---|---|---|
| 1. Polyester resin | Cargill 30-3016 | 93 |
| Carbon black | Cabot Black Pearls L | 5 |
| Charge control agent | Bontron P51 | 2 |
| 2. Polyester resin | UCB Crylcoat 340 | 93 |
| Carbon black | Cabot Black Pearls L | 5 |
| Charge control agent | BASF FF4102 | 2 |
| 3. Polyester resin | Cargill 30-3016 | 96 |
| Pigment blue | Irgalite Blue GLVO | 2 |
| Charge control agent | BASF FF4102 | 2 |
| 4. Polyester resin | Atlac T500 | 90 |
| Carbon black | Cabot Black Pearls L | 10 |
| 5. Polyester resin | Cargill 30-3016 | 93 |
| Carbon black | Cabot Elfex 280 | 5 |
| Charge control agent | Bontron P5 1 | 2 |

-continued

| Surface Treatment Blend | Blend 1 | Blend 2 | Blend 3 | Blend 4 |
|---|---|---|---|---|
| Fine inorganic powder 1 | SiO2 | SiO2 | SiO2 | SiO2 |
| surface treatment | HMDS* | HMDS* | Aminosilane | HMDS* |
| Amount used (wt. parts) | 0.75 | 1.25 | 1.25 | 0.75 |
| Fine inorganic powder 2 | Al203 | TiO2 | TiO2 | TiO2 |
| surface treatment | Trimethyl octyl silane | Methyl trimethoxy silane | Trimethoxy octyl silane | Octyl trimethoxy silane |
| Amount used (wt. parts) | 1.00 | 0.50 | 0.50 | 1.00 |
| Powder lubricant | ZnSt** | ZnSt** | ZnSt** | ZnSt** |
| Amount used (wt. parts) | 0.00 | 0.15 | 0.20 | 0.00 |

*hexamethyldisilazane
**zinc stearate

Each Surface Treatment Blend was separately admixed with each Base Toner Composition. In each case, the total weight parts of Surface Treatment Blend were made up to 100 parts with the relevant base toner composition In the light of this disclosure, modifications of the described examples, as well as other examples, all within the scope of the present invention as defined by the appended claims will now become apparent to persons skilled in the art.

What is claimed is:

1. A powder toner composition comprising:

at least 85% by weight of particulate synthetic thermoplastic material;

a primary refractory metal oxide;

a secondary refractory metal oxide; and a powder lubricant, wherein the particulate synthetic thermoplastic material is surface coated with a blend of the primary and secondary refractory metal oxides and the powder lubricant, and at least one of the primary and secondary refractory metal oxides is surface-treated.

2. The composition according to claim 1, which exhibits fluid properties when subjected to mechanical agitation or aeration and which settles as a compacted solid when the agitation or aeration ceases, said composition exhibiting behaviour substantially free of slugging, channelling and jetting when aerated.

3. The composition according to claim 1, wherein the surface-treated refractory metal oxide is surface coated with a silane coupling agent.

4. The composition according to claim 1, wherein the primary refractory metal oxide is a silica.

5. The composition according to claim 1, wherein the secondary refractory metal oxide is selected from titanium dioxide and alumina.

6. The composition according to claim 1, wherein the amounts of the primary and secondary refractory metal oxides are independently selected from the range from 0.05 to 5.0% by weight of the total composition.

7. The composition according to claim 1, wherein the primary and secondary refractory metal oxides have a $d_{50}$ mean particle diameter of less than 1 micron.

8. The composition according to claim 1, wherein the particulate thermoplastic material comprises a polyester resin.

9. The composition according to claim 8, wherein the polyester resin has at least one hydroxyl functional group.

10. The composition according to claim 1, wherein the composition comprises a magnetizable material.

11. The composition according to claim 1, comprising no more than 98% by weight of the particulate thermoplastic material.

12. The composition according to claim 1, wherein the particulate thermoplastic material has a dielectric constant of no more than 10.

13. The composition according to claim 1, comprising a charge control agent.

14. The composition according to claim 1, wherein the amount of the charge control agent is from 0.5 to 5% by weight of the total composition.

15. The composition according to claim 1, comprising a powder lubricant.

16. The composition according to claim 1, wherein the amount of powder lubricant is no more than 1% by weight of the total composition.

17. The composition according to claim 1, having a compaction ratio of at least 3:2.

18. The composition according to claim 1, having a viscosity of from 1 to 8 centipoise.

19. The composition according to claim 1, wherein the primary refractory metal oxide is silica, and the secondary refractory metal oxide is titanium dioxide or alumina, and the ratio of the primary refractory metal oxide to the secondary refractory metal oxide is greater than 1:1.

20. The composition according to claim 19, wherein the ratio of the primary refractory metal oxide to the secondary refractory metal oxide is greater than 2:1.

* * * * *